US008168911B2

(12) United States Patent
Asokan et al.

(10) Patent No.: US 8,168,911 B2
(45) Date of Patent: May 1, 2012

(54) CIRCUIT BREAKER WITH IMPROVED ARC QUENCHING

(75) Inventors: Thangavelu Asokan, Bangalore (IN); Ranjit Manohar Deshmukh, Bangalore (IN); Ranganath Gururaj, Bangalore (IN); Kamal Pandey, Udam Singh Nagar (IN)

(73) Assignee: General Electric Company, Schenectady, NY (US)

( * ) Notice: Subject to any disclaimer, the term of this patent is extended or adjusted under 35 U.S.C. 154(b) by 794 days.

(21) Appl. No.: 12/234,061

(22) Filed: Sep. 19, 2008

(65) Prior Publication Data

US 2010/0072174 A1 Mar. 25, 2010

(51) Int. Cl.
*H01H 33/02* (2006.01)

(52) U.S. Cl. ..... 218/156; 218/46; 218/153

(58) Field of Classification Search ..... 218/7, 15, 218/34, 36, 38, 40, 41, 149–158; 335/201, 335/202

See application file for complete search history.

(56) References Cited

U.S. PATENT DOCUMENTS 3,632,926 A * 1/1972 Heft ..... 218/90
6,717,090 B2 * 4/2004 Kling et al. ..... 218/151
2008/0073326 A1 * 3/2008 Asokan et al. ..... 218/35

* cited by examiner

*Primary Examiner* — Renee Luebke
*Assistant Examiner* — Marina Fishman
(74) *Attorney, Agent, or Firm* — Cantor Colburn LLP

(57) ABSTRACT

A circuit breaker having an arc quenching system is provided. The quenching system includes an ablative device positioned within a chamber. On end of the ablative device includes an opening that receives a stationary contact. A movable contact arm travels within a channel between the closed position and an open position. When an abnormal operating condition is detected, the circuit breaker trips causing the contact arm to move. This generates a plasma arc that evaporates material from the ablative device. The evaporated material generates a pressurized gas that cools and quenches the plasma arc to improve the performance of the circuit breaker during undesired operating conditions such as a short circuit.

17 Claims, 5 Drawing Sheets

CIRCUIT BREAKER WITH IMPROVED ARC QUENCHING

BACKGROUND

The present invention relates to a circuit breaker, and particularly relates to a circuit breaker having an ablative arc quenching arrangement.

Circuit breakers are used in a wide variety of applications for controlling the flow of electrical current to an electrical circuit when an undesired electrical condition is detected. Circuit breakers typically include three major subassemblies: an operating mechanism, a trip unit and an interrupter. The trip unit and operating mechanism cooperate to activate the interrupter when the undesired condition is detected.

The interrupter typically has a movable contact arm that carries a movable contact. A stationary contact is arranged to be in contact with the movable contact when the contact arm is in the closed position. An assembly commonly referred to as an arc chute is positioned adjacent the path of the movable contact. The arc chute is comprised of a plurality of thin steel plates that are spaced apart along the path of the movable contact. Typically, the plates will have a portion removed allowing the movable contact to move within a slot created in the arc chute by the removed portion. Due to the performance requirements of the arc chute, many plates are typically required to be assembled into thermoset side plates, a costly and time consuming process.

When an abnormal operating condition is detected, the interrupter is activated causing the movable contact to separate and move away from the stationary contact. During this separation process, a plasma arc is formed between the contacts and electrical current continues to flow through the circuit breaker until the arc is extinguished. Generally, circuit breakers are designed to transfer the plasma arc into the arc chute as the contacts separate. The arc chute absorbs the energy, stretches the arc and increases the arc resistance causing the arc to eventually be extinguished. However, during this process vaporized metal is generated and exhausted from the circuit breaker along with hot gases from the plasma arc.

Accordingly, while present circuit breaker systems are suitable for their intended purposes, there is a need in the art for a circuit breaker arc quenching arrangement that improves performance and reduces manufacturing costs.

BRIEF DESCRIPTION OF THE INVENTION

A circuit breaker is provided having a chamber. An ablative device is positioned within the chamber. The ablative device has a first opening at an end and a plurality of vent openings along a side. A contact arm movable between a closed position and an open position is positioned within the chamber. A movable contact is coupled to the contact arm, wherein the movable contact is adjacent the plurality of vent openings when the contact arm is in the closed position, is in the open position, and is in an intermediate position between the closed and open positions. A stationary contact is positioned within the ablative device first opening, wherein the stationary contact is positioned such that the movable contact is in electrical contact with the stationary contact when the contact arm is in the closed position.

In another embodiment, a circuit breaker is provided with a stationary contact. A contact arm having a movable contact is arranged with the movable contact being in contact with the stationary contact when the contact arm is in a closed position, and wherein the movable contact and the stationary contact are separated by a first distance when the contact arm is in an open position. An ablative member is provided having a first opening disposed about the stationary contact. The ablative member has a channel extending along a first side with a plurality of vent openings extending from a second side, wherein the movable contact is positioned within the channel as the contact arm moves from the closed position to the open position. A vent channel is arranged in fluid communication with the plurality of vent openings, the vent channel having an end adjacent a load terminal.

A method of operating a circuit breaker is also provided including the step of detecting an undesired electrical condition. A movable contact is separated from a stationary contact in response to the detection of the undesired electrical condition. In response to the separation of the movable contact from the stationary contact a gas is ablated. An arc generated by the separation of the movable contact from the stationary contact is cooled with the ablated gas. The ablated gas is vented through a first vent opening positioned adjacent the stationary contact.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

As illustrated in FIGS. 1-5, circuit breaker 20 is an electrical distribution device that is used to control the flow of electrical current into a circuit. The circuit breaker 20 is generally arranged to open under abnormal operating conditions, such as a short circuit for example. When opening under such abnormal operating conditions, sometimes referred to as "interruption", a stationary contact 22 and a movable contact 24 within the circuit breaker 20 separate. The separation of the contacts 22, 24 creates a plasma arc that needs to be cooled and quenched before the flow of electrical current may be halted.

Figure 1:
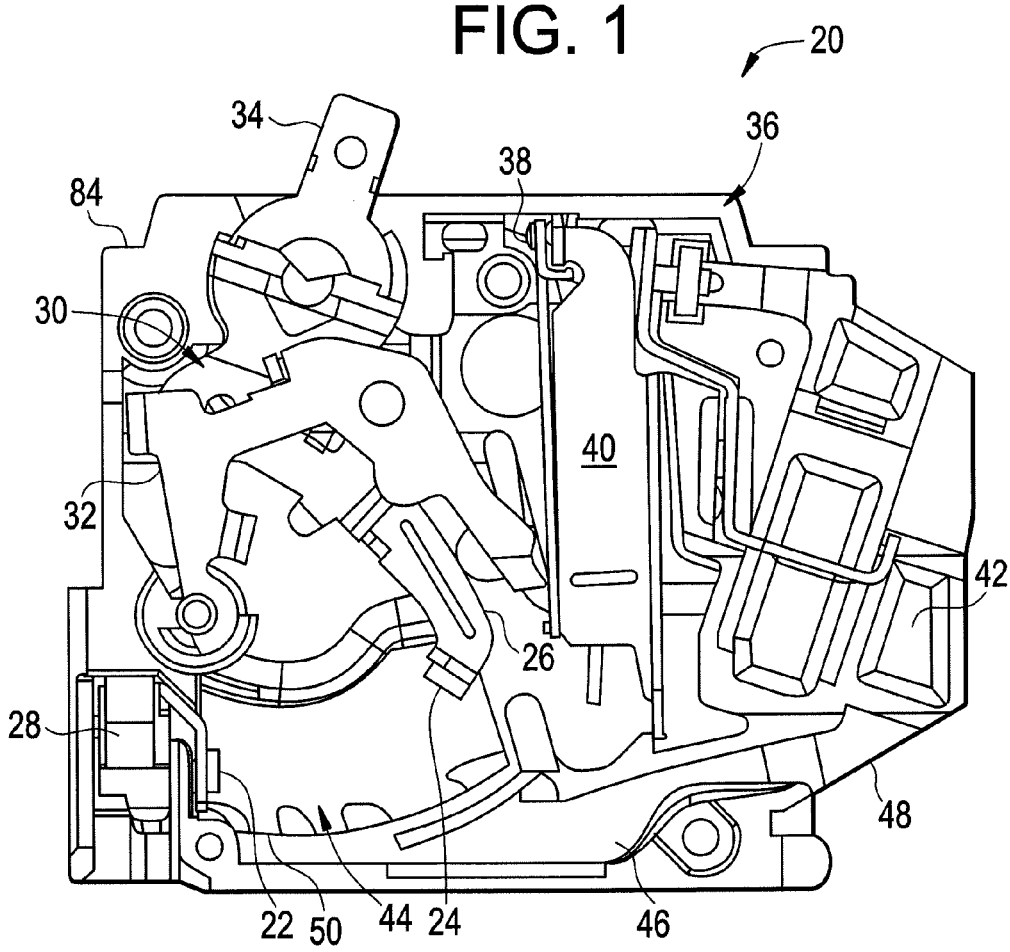
FIG. 1 is side plan view of a circuit breaker in the open position in accordance with an exemplary embodiment.
Figure 2:
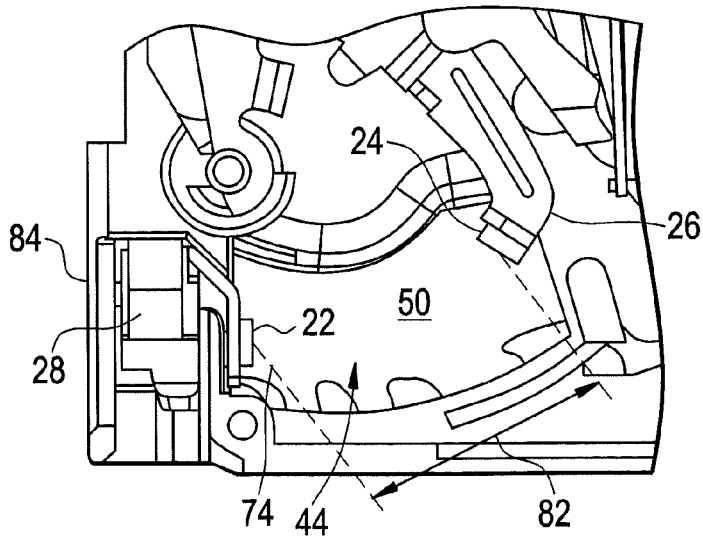
FIG. 2 is a partial side plan view of the circuit breaker of FIG. 1.
Figure 3:
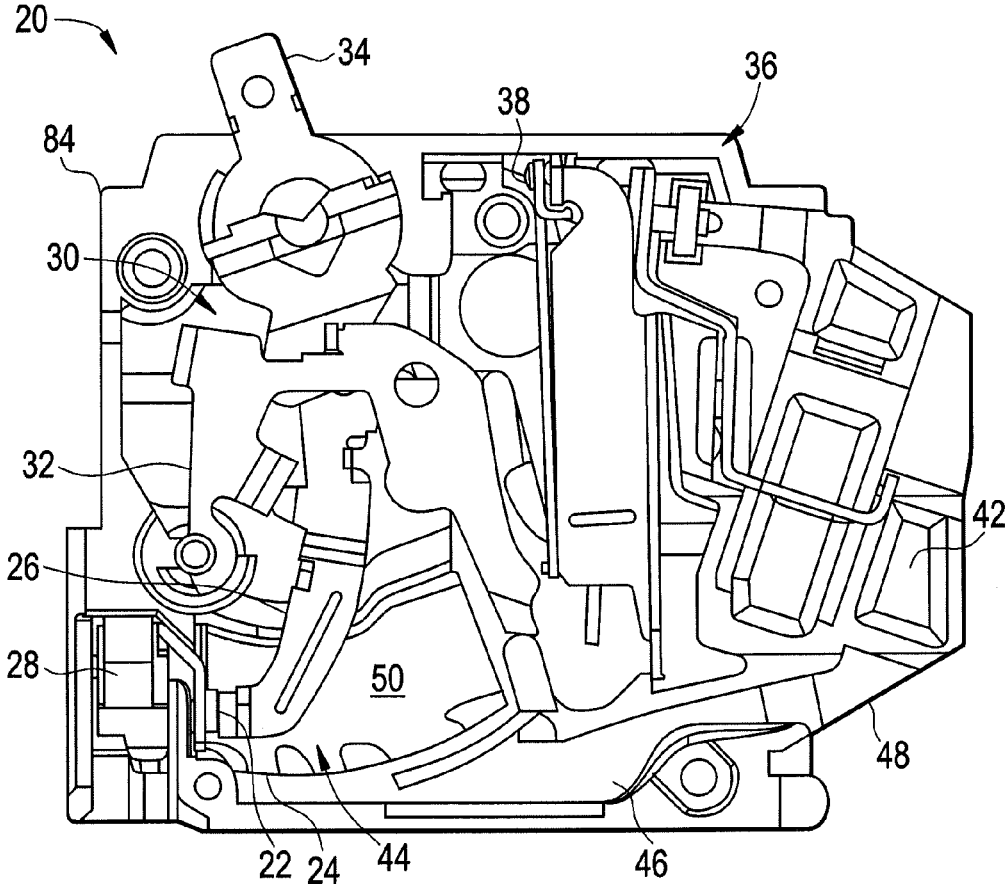
FIG. 3 is a side plan view of the circuit breaker of FIG. 1 in the closed position.
Figure 4:
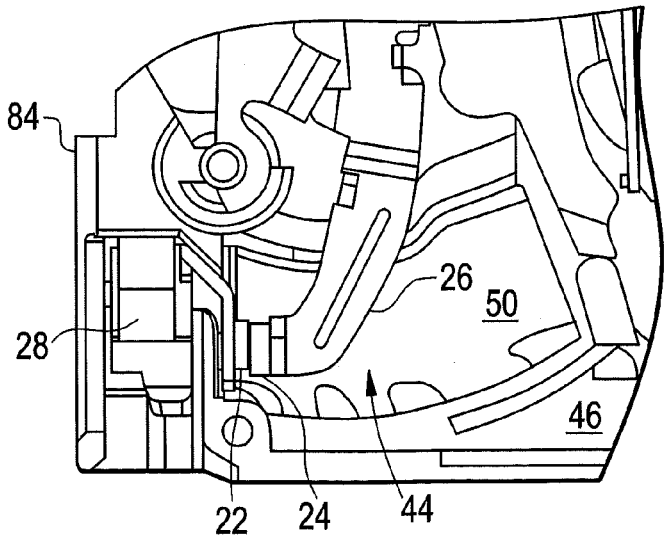
FIG. 4 is a partial side plan view of the circuit breaker of FIG. 3.

To assist in the separation of the movable contact 24 from the stationary contact 22, the circuit breaker 20 includes one or more contact arms 26 that are arranged to move between an closed state shown in FIG. 2 and FIG. 3, where current flows from a power source to a load (not shown), and an open state shown in FIG. 1 and FIG. 2 where the flow of electrical power is interrupted. The contact arm 26 is electrically coupled to a "stab" or inlet terminal 28 that electrically connects the circuit breaker 20 to a power source. The contact arm 26 is further coupled to a mechanism 30 that includes components such as springs (not shown) and linkages 32 to move the contact arm 26 from a closed to an open position when activated by an operator through an opening switch or handle 34 for example. The mechanism 30 is coupled to a trip assembly 36 through a latch 38. The trip assembly 36 includes members such as a magnet 40 or a thermally responsive device, such as a bi-metal device (not shown) for example. The trip assembly responds to undesired abnormal operating conditions to release the latch 38, causing the mechanism 30 to move the contact arm 26 from the closed to the open position. A load terminal 42 is electrically connected to the contact arm 26 to connect the circuit breaker 20 to an electrical circuit.

The mechanism 30 may alternatively be coupled to an electronic trip unit (not shown). An electronic trip unit typically includes a controller with a processor that executes computer instructions for controlling the operation of the circuit breaker 20. A set of current transformers (not shown) provide a signal to the electronic trip unit indicative of the current level flowing through the circuit breaker 20 into an electrical circuit.

The contact arm 26 moves within an enclosed chamber 44, sometimes referred to as an arc chamber. As will be discussed in more detail herein, the chamber 44 contains the gases generated during the current interruption. These gases flow into a vent channel 46, which transfers the gases out of the circuit breaker 20 adjacent the load terminal 42. The end of the vent channel 48 is arranged to direct the gases, which may be ionized and contain vaporized metal, away from the load terminal 42 to prevent an electrical arc from forming between the gases and electrical conductors connected to the load terminal 42.

In the exemplary embodiment, an ablative device 50 is positioned within the chamber 44. The ablative device 50 is made from a material that evaporates at high temperatures creating a gas that pressurizes the chamber 44. As such, the ablative device may be a polymer, such as but not limited to polyoxymethylene (such as Delrin® manufactured by E.I. du Pont de Nemours and Company for example), phenolic-fabric composites (such as manufactured by Hylam® manufactured by Bakelite Hylam Ltd. for example), epoxy or polytetrafluoroethylene (such as Teflon® manufactured by E.I. du Pont de Nemours and Company for example).

Figure 5:
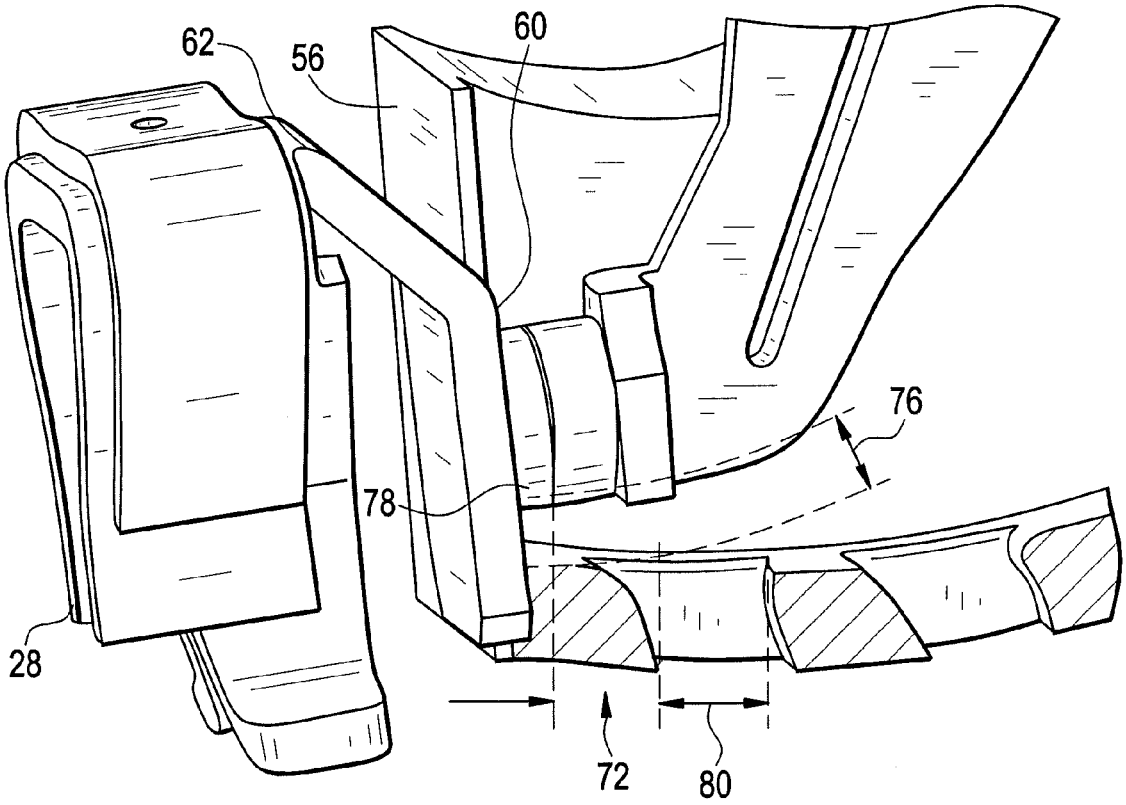
FIG. 5 is partial perspective view illustration of the contact arm structure and ablative device of FIG. 1.
Figure 6:
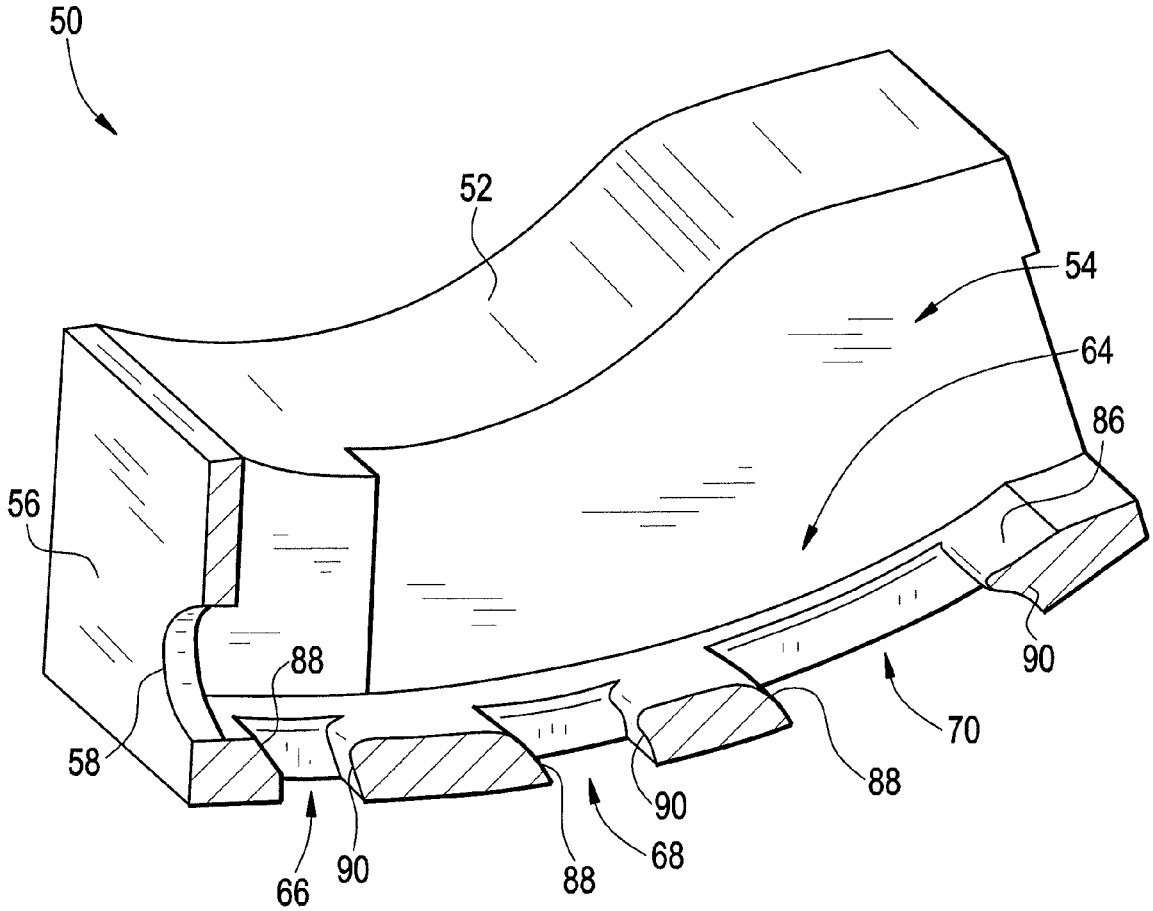
FIG. 6 is a perspective sectional view illustration of the ablative device of FIG. 1; and, FIG. 7 is a bar graph illustration of let through energy for a plurality of samples in accordance with an embodiment.

As illustrated in FIG. 5 and FIG. 6, the ablative device 50 includes a sidewall 52. It should be appreciated that the ablative device 50 is illustrated in section for purposes of clarity and that ablative device 50 further includes an additional sidewall 52. The sidewalls 52 cooperate to form the side of a channel 54 in which the contact arm 26 and the movable contact 24 travels during the transition of the circuit breaker from the closed to open position. An end wall 56 is positioned along one end of the channel 54. An opening 58 sized to fit the stationary contact 22 is arranged within the end wall 56. When the ablative device 50 is positioned in the chamber 44, the end wall 56 rests on the top surface 60 of a conductor 62 with the stationary contact 22 within the opening 58. The conductor 62 electrically connects the stationary contact with the inlet terminal 28.

The ablative device further includes a plurality of vent openings 64. In the exemplary embodiment, the plurality of vent openings 64 include a first vent opening 66, a second vent opening 68, and a third vent opening 70. The vent openings 64 provide a path for the gases, both ablative gases and arcing gases, to flow from the chamber 44 into the vent channel 46. The first vent opening 66 is positioned at a first distance 72, and at a radial gap 76, from the top surface 74 and edge 78 of the stationary contact 22 respectively. The first vent 66 further has a width 80. In the exemplary embodiment, the first distance 72 is between 1 millimeter and 5 millimeters and preferably 1 millimeter. The radial gap 76 is between 1 millimeter and 2 millimeters and preferably 2 millimeters. The width 80 is between 2 millimeters and 4 millimeters, and preferably 4 millimeters. In the exemplary embodiment, the second vent opening 68 and the third vent opening 70 are the same size or larger than the first opening 66. In one embodiment, the third vent opening 70 is larger than the second vent opening 68 as well.

In one embodiment, the ablative device 50 includes an inner surface 86 at the entrance to the plurality of vent openings 64. The inner surface 86 may be a cylindrical surface with an axis positioned coaxially with the center of rotation of the contact arm 26. In another embodiment, the axis of inner surface 86 is offset from the center of rotation of the contact arm 26 such that the radial gap between the movable contact 24 and the inner surface 86 increases as the contact arm 26 moves from the closed to the open position.

In the exemplary embodiment, the transition between the inner surface 86 and the plurality of vent openings 64 includes a radius 88. Further, the sides of each of the plurality of vent openings 64 may include curved surfaces 90. The radius 88 and curved surfaces 90 are arranged to facilitate the flow of gases from the channel 54 into the vent channel 46 and avoid restricting the gas flow. By facilitating the flow of gases from the channel 54 into the vent channel 46, the pressure within the chamber 44 may be controlled to desired levels. As will be discussed below, this provides advantages in maximizing interruption performance in quenching the plasma arc while also minimizing the risk of damaging the housing 84.

The gases produced by the ablative device 50 have a cooling and constricting effect on the plasma arc. This provides advantages by increasing the arc resistance that aids the quenching of the plasma arc. In addition, the gas that exists via the vent channel 46 is also cooler reducing its impact on surround equipment. In general, the more ablative gas that is generated, the faster the plasma arc is cooled and quenched. However, the larger the amount of ablative gas, the higher the pressure within the chamber 44. This pressure places a stress on the housing 84 of the circuit breaker 20. Therefore, the beneficial affects of the ablative device 50 need to be balanced against the strength of the housing 84, otherwise the housing 84 may be damaged. As a result, the position and arrangement of the plurality of vent openings 64 affects the performance of the circuit breaker 20 during the interruption of current. A fourth parameter, the distance 82 between the stationary contact 22 and the movable contact 24 when the circuit breaker is in the open position also effects the performance of circuit breaker 20. In general, the larger the distance 82, the longer the arc and the greater the arc resistance and the better the interruption performance. In the exemplary embodiment, the distance 82 is 20 millimeters.

During operation, the circuit breaker 20 is in the closed position with electrical current flowing from the inlet terminal 28, through the contact arm 26, and exiting via the load terminal 42. Upon the detection of a predetermined condition, such as an electrical fault for example, the trip assembly 36 releases the latch 38 causing the mechanism 30 to move the contact arm 26 from the closed to the open position. As the movable contact 24 starts to separate from the stationary contact 22, a plasma arc is formed between the contacts 22, 24. One property of the plasma arc is that it allows electrical current to continue to flow from the inlet terminal 28 to the load terminal 42. In the case of an abnormal condition such as a short circuit for example, the electrical current flowing through the circuit breaker 20 may be many times the level of normal operating conditions. To avoid damaging the downstream wiring and equipment, it is desirable therefore to quench the plasma arc to minimize the amount of electrical current that flows downstream.

As the contacts 22, 24 separate, the plasma arc evaporates material from the ablative device 50. The material from the end 56 of side wall 52 being closest to the contacts 22, 24 evaporates first as the contacts 22, 24 separate. Material from sidewall 52 and surface 86 evaporates creating a gas that cools the arc and also tends to constrict the size of the arc as the contact arm 26 continues to move towards the open position. In the exemplary embodiment, a majority of the ablation gases are generated by the side wall 52. Further, it should be appreciated that the evaporation of material from ablative device 50 increases the pressure within the chamber 44. Since gas will normally flow from a high-pressure region to a low-pressure region, the generated gas flows through the plurality of vent openings 64 and into the vent channel 54.

As discussed above, the size and position of the plurality of vents 64 impacts the interruption performance of the circuit breaker 20. One measure of this performance is a metric commonly referred to as "let-through" energy having units $kA^2$ Sec. The let-through energy indicates the amount of energy that is received downstream from the circuit breaker 20 in the event of an abnormal condition, such as a short circuit for example.

Figure 7:
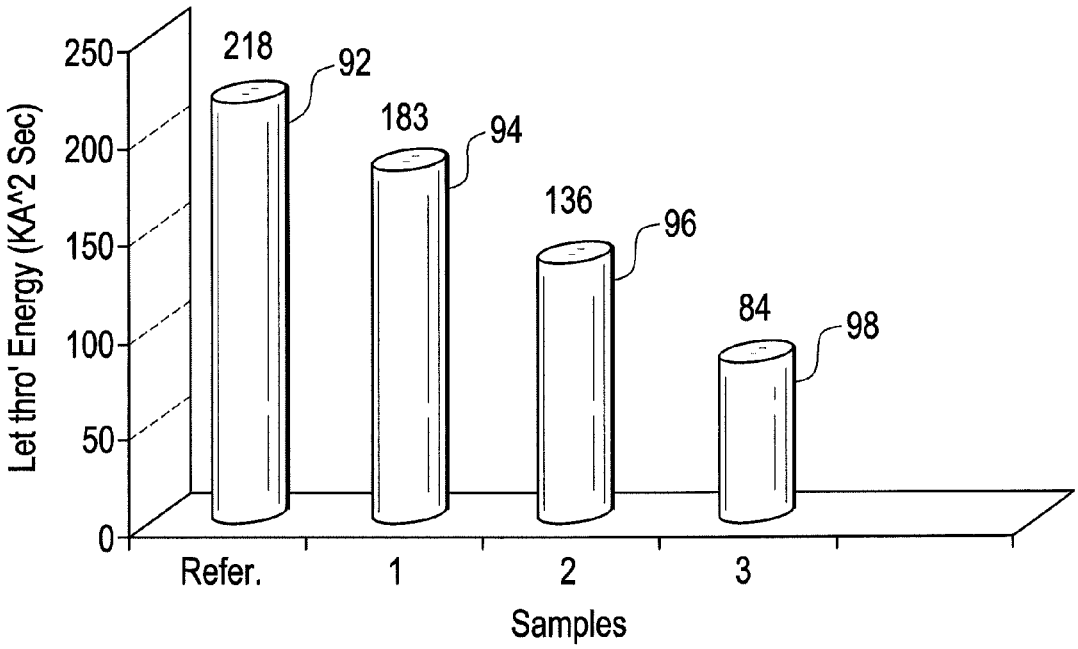

Referring to FIG. 7, a series of tests were conducted on a circuit breaker 20 based on a commercially available circuit breaker modified in accordance with an embodiment of the invention disclosed herein to remove the standard arc chute assembly and replace it with the ablative device 50. As a reference, the standard circuit breaker with an arc chute was tested under short circuit conditions of 6 kA root mean square (RMS) current at 255 volts, and the let through energy measured. The let-through energy for the standard circuit breaker was 218 $kA^2$ Sec as indicated by bar 92. Next, a sample was prepared where the distance 82 was increased from 13 millimeters in the standard circuit breaker to 20 millimeters. This resulted in a drop in the let-through energy to 183 $kA^2$ Sec as indicted by bar 94.

While keeping the distance 82 at 20 millimeters, a series of tests were conducted with ablative device 50 where the first distance 72 was varied from 5 millimeters to 1 millimeter. In these tests, the let-through energy started at 171 $kA^2$ Sec for the ablative device having a 5 millimeter distance 72 and progressively dropped to 136 $kA^2$ Sec for an ablative device 50 having a 1 millimeter distance 72 as indicated by bar 96. In addition to the lower let-through energy, the sample having a 1 millimeter distance 72 showed less signs of stress from the pressure generated by the evaporation of material from the ablative device 50 since the placement of the first vent 66 closer to the stationary contact 22 allowed for a more rapid relief of gas pressure.

Next, a series of tests were conducted where the radial gap 76 was varied between 1 millimeter to 2 millimeters while the vent width 80 for the first vent opening 66 is varied between 2 millimeters and 4 millimeters. In these tests, the distance 72 remained at 1 millimeter and the opening distance 82 remained at 20 millimeters. In these tests, the let-through energy dropped when the vent width was increased and the radial gap 76 was also increased. When a 2-millimeter radial gap 76 was combined with a 4-millimeter vent opening width 80, the let-through energy dropped to 84 $kA^2$ Sec as represented by bar 98. Thus, the use of the ablative device 50 with an appropriately sized and positioned first vent opening 66 resulted in an approximately 62% drop in let-through energy over the commercially available circuit breaker. It should be appreciated that while it would appear that increased flow of gases improves performance, there is a limit to this improvement since the pressure generated by the ablative gas also constricts the size of the arc. Therefore, it is contemplated that if the plurality of vent openings 64 were removed, that there would be a deteriorating effect on performance since the gas pressure would be insufficient to constrict and cool the arc.

The circuit breaker 20 having ablative device 50 may include one or more advantages. By replacing a typical arc chute assembly with an ablative device, the number of components and the amount of labor required for manufacturing the circuit breaker may be dramatically reduced. The gas evaporated from the ablative device may also cool the gases that are exhausted through the circuit breaker vents, which may reduce the potential for damaging or affecting the surrounding environment and equipment. Further, the ablative device with a plurality of vents for controlling the flow of gas from the chamber may reduce the let-through energy.

While the invention has been described with reference to exemplary embodiments, it will be understood that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. A circuit breaker comprising:

a chamber;

an ablative device within said chamber, said ablative device having a first opening at a first end, a cylindrical inner surface proximate the first end, and a plurality of vent openings arranged on the cylindrical inner surface;

a contact arm within said chamber, said contact arm movable between a closed position and an open position;

a movable contact coupled to said contact arm, wherein said movable contact is adjacent to said plurality of vent openings; and, a stationary contact positioned within said ablative device first opening wherein the cylindrical inner surface comprises a central axis positioned coaxially with a center of rotation of the contact arm.

2. The circuit breaker of claim 1 wherein said ablative device includes a channel adjacent said contact arm.

3. The circuit breaker of claim 2 wherein said plurality of vent openings extend from said channel opposite a channel open side.

4. The circuit breaker of claim 3 wherein said plurality of vent openings includes a first vent opening arranged closest to said stationary contact, said first vent opening being positioned a first distance from a top surface of said stationary contact and a second distance from the edge of said stationary contact, said first vent opening further having a width associated therewith.

5. The circuit breaker of claim 4 wherein said movable contact is a third distance from said stationary contact when said contact arm is in said open position.

6. The circuit breaker of claim 5 wherein said first distance is between about 1 millimeter and 5 millimeters.

7. The circuit breaker of claim 6 wherein said second distance is between 1 millimeter and 2 millimeters.

8. The circuit breaker of claim 7 wherein said width is between 2 millimeters and 4 millimeters.

9. The circuit breaker of claim 8 wherein said first distance is 1 millimeter, said second distance is 2 millimeters, said width is 4 millimeters and said third distance is 20 millimeters.

10. A circuit breaker comprising:

a stationary contact;

a contact arm having a movable contact coupled thereto, wherein said contact arm is positioned with said movable contact being in contact with said stationary contact when said contact arm is in a closed position, and wherein said movable contact and said stationary contact are separated by a first distance when said contact arm is in an open position;

an ablative member having a first opening disposed about said stationary contact, said ablative member having a cylindrical inner surface proximate the first opening, a channel extending along the cylindrical inner surface, and a plurality of vent openings arranged on the cylindrical inner surface, wherein said movable contact is positioned within said channel as said contact arm moves from said closed position to said open position; and, a vent channel in fluid communication with said plurality of vent openings, said vent channel having an end adjacent a load terminal;

wherein the cylindrical inner surface comprises a central axis positioned coaxially with a center of rotation of the contact arm.

11. The circuit breaker of claim 10 wherein said vent channel is opposite said channel.

12. The circuit breaker of claim 11 wherein said plurality of vent openings includes a first vent opening positioned adjacent to said stationary contact.

13. The circuit breaker of claim 12 wherein said first vent opening is disposed a first distance from the top of said stationary contact and said first vent opening, and wherein there is a radial gap between an edge of said stationary contact and said first vent opening.

14. The circuit breaker of claim 13 wherein said first vent opening further has a first width.

15. The circuit breaker of claim 14 wherein said first distance is equal to or greater than 20 millimeters, said second distance is 1 millimeter, said radial gap is 2 millimeters and said width is 4 millimeters.

16. The circuit breaker of claim 14 wherein said plurality of vent openings further includes a second vent opening having a second width and a third vent opening having a third width, wherein said second width and said third width are larger than said first width.

17. The circuit breaker of claim 15 wherein said ablative member is made from a material selected from a group comprising: polyoxymethylene, phenolic-fabric composite, epoxy and polytetrafluoroethylene.

* * * * *